US005283971A

United States Patent [19]

Fuller et al.

[11] Patent Number: 5,283,971

[45] Date of Patent: Feb. 8, 1994

[54] TRIGGER GUARD ALARM FOR A FIREARM

[76] Inventors: Robert M. Fuller; Ann D. Fuller, both of P.O. Box 908, Helen, Ga. 30545; Richard P. Smyth, 3649 Cherbourg Rd., Marietta, Ga. 30062

[21] Appl. No.: 926,924

[22] Filed: Aug. 7, 1992

Related U.S. Application Data

[63] Continuation-in-part of Ser. No. 848,704, Mar. 9, 1992, Pat. No. 5,191,158.

[51] Int. Cl.[5] ..... F41B 17/54

[52] U.S. Cl. ..... 42/70.07; 42/70.06; 42/70.11

[58] Field of Search ..... 42/1.01, 70.11, 70.07, 42/70.06, 70.01

[56] References Cited

U.S. PATENT DOCUMENTS

| | | | |
|---|---|---|---|
| 3,392,471 | 7/1968 | Foote | 42/70.06 |
| 3,956,842 | 5/1976 | Ballenger | 42/70.07 |
| 4,476,644 | 10/1984 | Laing | 42/1.01 |
| 4,499,681 | 2/1985 | Bako et al. | 42/70.07 |
| 4,719,713 | 1/1988 | Hagle | 42/1.01 |
| 4,739,569 | 4/1988 | Battle | 42/1.01 |
| 5,016,378 | 5/1991 | Sain | 42/70.06 |
| 5,022,175 | 6/1991 | Oncke et al. | 42/70.11 |
| 5,050,328 | 9/1991 | Insko | 42/70.07 |

FOREIGN PATENT DOCUMENTS

| | | | |
|---|---|---|---|
| 3116707 | 11/1982 | Fed. Rep. of Germany | 42/70.11 |
| 3607303 | 9/1987 | Fed. Rep. of Germany | 42/70.01 |
| 138331 | 9/1952 | Sweden . | |
| 1290330 | 12/1968 | United Kingdom . | |

*Primary Examiner*—Stephen M. Johnson
*Attorney, Agent, or Firm*—Needle & Rosenberg

[57] ABSTRACT

A trigger guard alarm system for a firearm which comprises a trigger locking device and a means for generating an alarm to indicate unauthorized removal of the trigger locking device. The alarm system is on the trigger lock and is activated by placing the lock around the trigger. The alarm is subsequently deactivated by entering a predetermined signal in the alarm generating means.

20 Claims, 5 Drawing Sheets

TRIGGER GUARD ALARM FOR A FIREARM

CROSS-REFERENCE TO RELATED APPLICATION

This application is a continuation-in-part of application Ser. No. 07/848,704, filed Mar. 9, 1992 now U.S. Pat. No. 5,191,158.

BACKGROUND OF THE INVENTIION

This invention relates to an apparatus for locking the triggers of firearms and, more particularly, to a trigger locking device that emits an alarm signal when unauthorized removal of the trigger locking device occurs.

Heretofore, various devices for locking the triggers of firearms have been developed See, for example, U.S. Pat. Nos. 3,392,471; 3,956,842; and 4,499,681; Swedish Patent No. 138,331; and British Patent No. 1,290,300.

Each year numerous accidental shootings, especially of children, occur as a result of gun owners leaving their firearms unattended. Children playing with such guns cause a major number of accidental deaths in the United States.

Currently, the two methods used to prevent accidental shootings include locking unattended guns in a cabinet and placing trigger locks on unattended firearms. Many gun owners prefer trigger locks because they allow the owners to have quick access to their firearms while still providing an impediment to unauthorized use.

The two types of trigger locks most commonly available are key-lock systems and non-key-lock systems. The key-lock systems require a key to unlock the trigger. The non-key-lock systems, conversely, require an adult's level of strength and dexterity to access the trigger. The key-lock systems have the advantage of assuring limited access to the gun. However, they do have some drawbacks: first, they require a certain amount of time to open—time which could be costly in an emergency; second, the only people who can have access are those who have keys; and third, owners who misplace their keys cannot gain access to their firearms even in emergencies Many firearm owners prefer the quick access afforded by the non-key lock systems. However, non-key lock systems have the drawback of still being accessible to older and stronger-than-average children. Furthermore, they do not impede access to unauthorized adults, such as burglars.

Therefore, the need exists for a trigger lock that provides both the quick access of non-key lock systems and the added security of key-lock systems.

SUMMARY OF THE INVENTION

The disadvantages of the prior art are overcome by the present invention, which incorporates an electronic alarm system into a non-key-lock trigger locking means as disclosed in co-pending application, Ser. No. 07/848,704, filed Mar. 9, 1992. The alarm of the present invention is activated whenever the locking means is applied to the trigger of a firearm and the alarm is deactivated by entering the correct combination on a numeric display on the side of the alarm system. If the trigger lock is removed without the alarm having been deactivated, or if an improper combination has been successively entered a preselected number of times, then an alarm will sound, thus alerting the firearm owner of attempted unauthorized use.

The trigger locking means of the device provides a clamping mechanism which overlies at least the trigger, and usually the trigger guard as well, depending upon the configuration of the weapon. The construction of the device includes the same trigger guard mechanism of the co-pending application, including a channel-shaped frame that has a pair of side walls which are interconnected along the rear edges by a back wall. A first element is fixed to the frame and extends outwardly from the bottom edges of the side walls. A second element, which is complementary in shape to the first element, is movable on the frame to assume an opposed relationship to the first element. Means are provided for securing the second element on the frame at a selected distance from the first element so as to retain and clamp therebetween at least the trigger of the weapon.

Mounted on the top of the first element of the device is an electronic alarm system. The alarm system includes a microcontroller which controls the activating and sounding of the alarm, an activator switch which activates the alarm when the locking means is applied to the firearm, a key pad and a display for entering a numerical lock combination, a battery power supply to power the alarm system, and an alarm signal generating means.

To operate this device, the user inserts a fully charged battery into the battery receptacle at the base of the alarm system. The user then clamps the locking device around the trigger guard of the firearm. The trigger guard puts pressure on the activator switch, which is mounted inside one of the pads in the clamshell-type trigger lock. Putting pressure on the activator switch causes it to activate the alarm system. If the locking device is subsequently removed from the firearm without entering a predetermined combination on the display, an alarm will sound.

The deactivation procedure includes inputting the correct numerical lock combination into the alarm system which will deactivate the alarm. The user can then remove the locking device from the firearm without sounding the alarm. If an incorrect code is entered a predetermined number of times, the alarm will sound and will continue to sound until the correct code is entered.

The object of the present invention is to provide an added level of security to a firearm trigger lock by incorporating into the lock an electronic alarm which detects and warns of unauthorized removal of the lock.

DETAILED DESCRIPTION OF THE INVENTION

Figure 1:
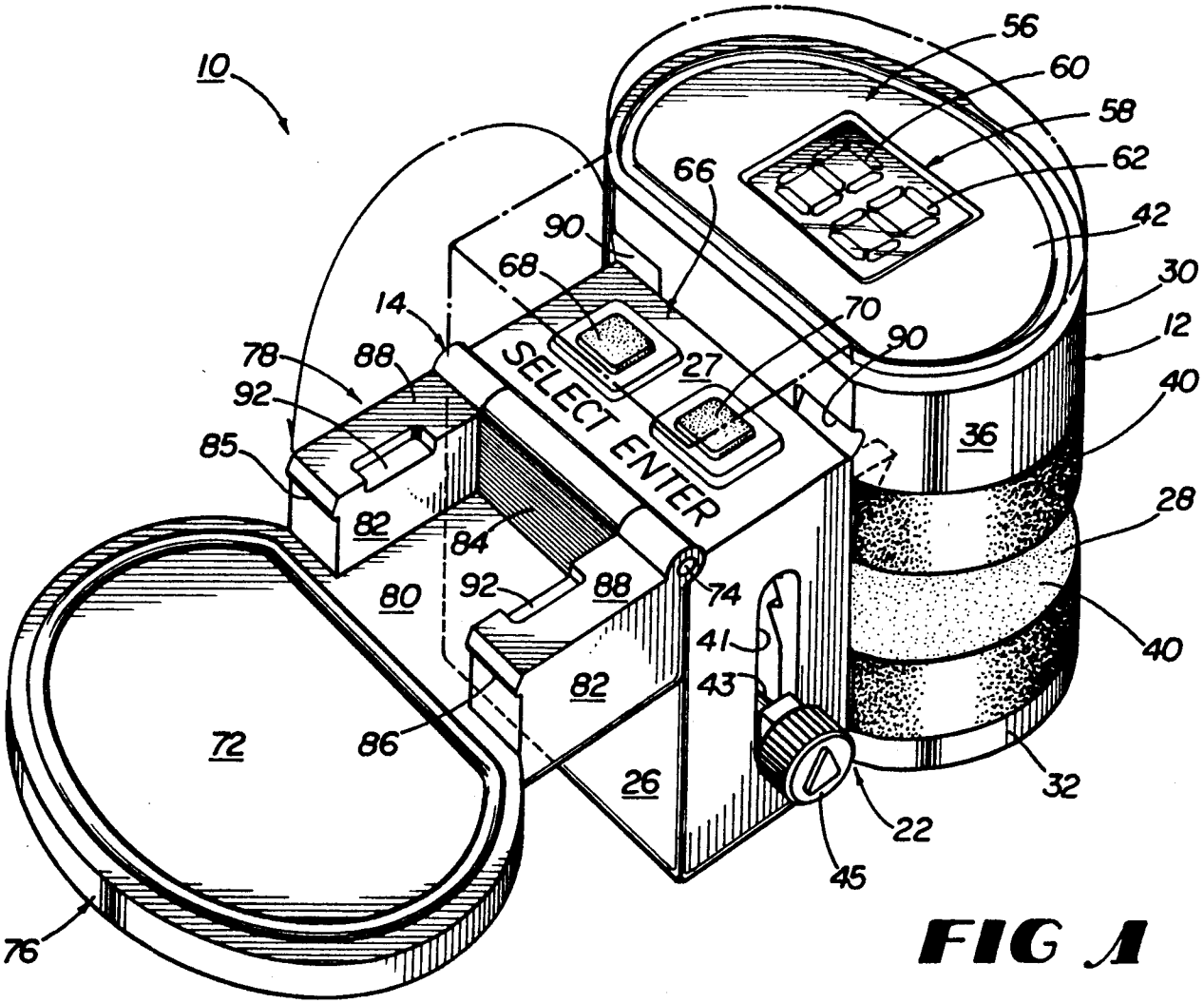
FIG. 1 is a perspective view of the trigger locking device of the present invention with the protective lid "open" exposing the combination entry and display mechanism.
Figure 2:
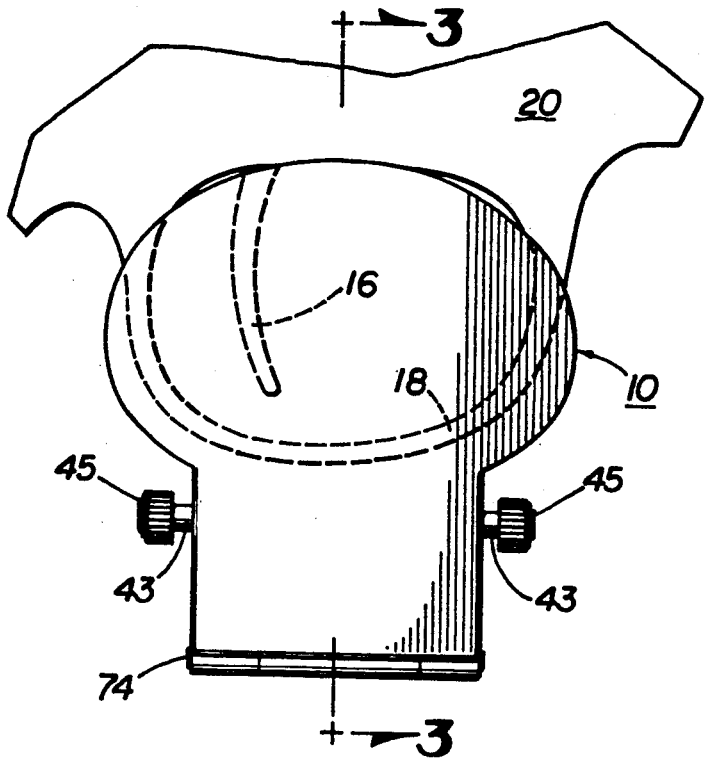
FIG. 2 is a partial side view of the alarm locking device of the present invention applied to the trigger of a firearm.

The preferred embodiment of this invention 10, as shown in FIG. 1, consists of a trigger locking device 12 for a firearm and an alarm generating means 14. The trigger locking device 12 prevents access to the trigger 16 by clamping about and immobilizing the trigger 16 and trigger guard 18 of the firearm 20, the device 12 thereby assuming its operative position The alarm generating means 14 is shown in conjunction with the clamshell-design firearm device of the above-mentioned application. However, it is understood that the clamshell structure merely acts as a carrier or frame for the alarm generating means 14 which can be incorporated into any suitable safety device structure which prevents the operation of the trigger I6.

As seen in Figs. I and 3, the trigger locking device 12 comprises a frame 22 having a pair of opposed side walls 24 joined by a rear wall 26 and top 27. Disposed within the frame 22 are first and second elements 28, 30 that are dimensioned so as to overlie on each side, and prevent access to, at least the trigger 16 when they are clamped together in their operative position The first element 28 is moveable vertically within the frame 22 and has a generally oval-shaped forward portion 32 and a smaller dimensioned, rearwardly extending portion 34. The lateral width of portion 34 is such that it is slightly less than the distance between the side walls 24 to allow the above-described vertical movement.

The second element 30 is fixed to the frame 22 and has a forward portion 36 that is similar in shape to forward position 32 and which forms the bottom surface of the alarm generating means 14. The rear portion 38 is integrally joined to the top of side walls 24. The opposed faces of the forward portions 32, 36 carry sponge-like cushions 40 which engage therebetween the trigger 16 and trigger guard 18.

The means for positioning the first element 28 at selected positions in opposed relationship to the second element 30 is described in detail in the above-described application. Generally, the positioning means includes a pair of legs (not shown) which depend from the first element about a "live hinge" and which have serrations thereon that selectively engage serrations (not shown) on the inner surface of the side walls 24. A spring (not shown) between the legs normally biases the serrations on the legs into mating engagement with the serrations on the side walls 24.

An elongated opening 41 vertically extends through the side walls 24. A shaft 43 affixed to each leg laterally projects through the openings 41. A circular button 45 is secured on the distal end of shaft 43. Inward movement of the shafts 43 causes the legs to move so that the serrations become disengaged from each other. The first element 28 can then be moved to its next position when the inward pressure on the legs is removed, allowing the serrations to engage each other again.

A housing 42 upwardly extends about the periphery of the forward portion 36. The front face of housing 42 has a grill 44 therethrough, as seen in FIG. 3, which provides a means for the sound to emanate from the alarm generating means 14.

Figure 3:
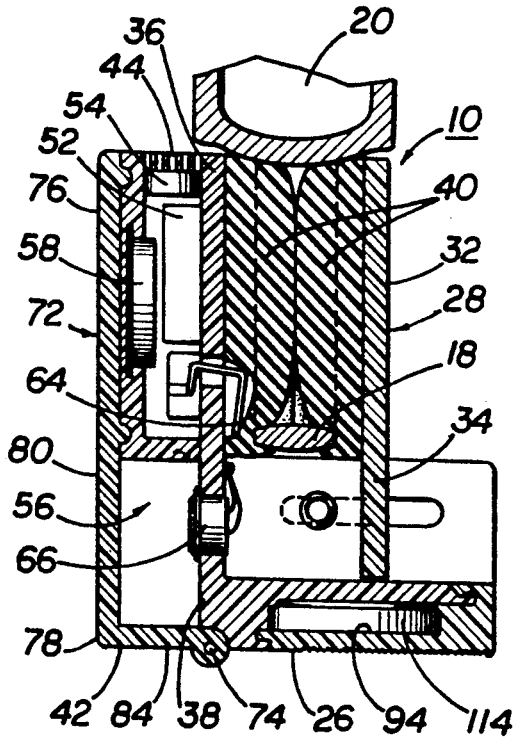
FIG. 3 is a view taken along line 3—3 in FIG. 2.

As seen in FIGS. 1 and 3, elements of the alarm generating means 14 contained in the housing 42 include the microcontroller 52 and an electronic horn 54 disposed behind the grill 44. The top 56 of the housing 42 has an opening therethrough so that the numerical display 58 is visible, the display 58 comprising two seven-segment units 60, 62. An activator switch 64 is mounted through the forward portion 36 for pivotal movement about a horizontal axis, as seen in FIG. 3. When the first and second elements 28, 30 are secured about the trigger 16 and trigger guard 18 so that the cushions 40 are in engagement with each other, the switch 64 is moved to its operative position, closing the activating circuit of the alarm generating means 14. When the cushions 40 are disengaged from each other, the switch 64 pivots to its inoperative, open position Acting as a numerical combination entry means, a keypad 66 is mounted on the top 27 and includes a "select" key 68 and an "enter" key 70. A cover 72 is mounted at the rear of the frame 22 for pivotal movement about pin 74. The cover 72 includes a front section 76 which is dimensioned to be complementary to and overlie the housing 42 and rear section 78. The rear section 78 comprises a top wall 80 from which the front section 76 extends and sides 82 which are joined by rear wall 84. Snap closure lugs 86 projecting from the bottom 88 of the sides 82 are received within recesses 90 in the back of the housing 42. Notches 92 are provided in the bottom 88 for engagement with the respective sides of the keys 68, 70. A battery receptacle 94 is provided in the rear wall 26 for powering the alarm generating means 14.

Figure 4:
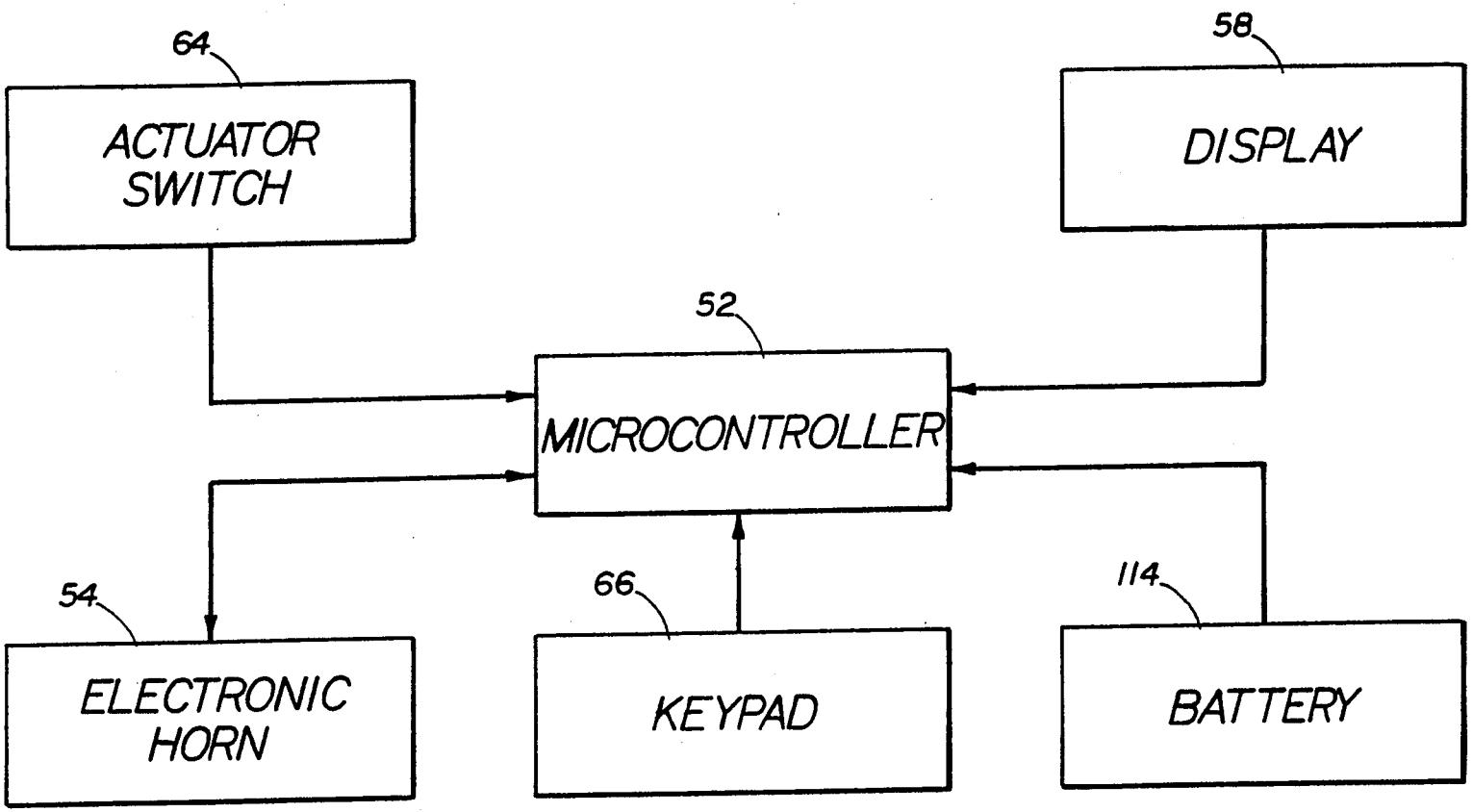
FIG. 4 is a block diagram of the alarm system of the present invention.

A block diagram of the electronics which comprise the alarm system is shown in FIG. 4. The microcontroller 52, powered by the battery power supply 114, receives logic signal input from the activator switch 64 and the key pad 66. It outputs numerical combination data to the display 58 and outputs alarm signals to the electronic horn 54

Figure 5:
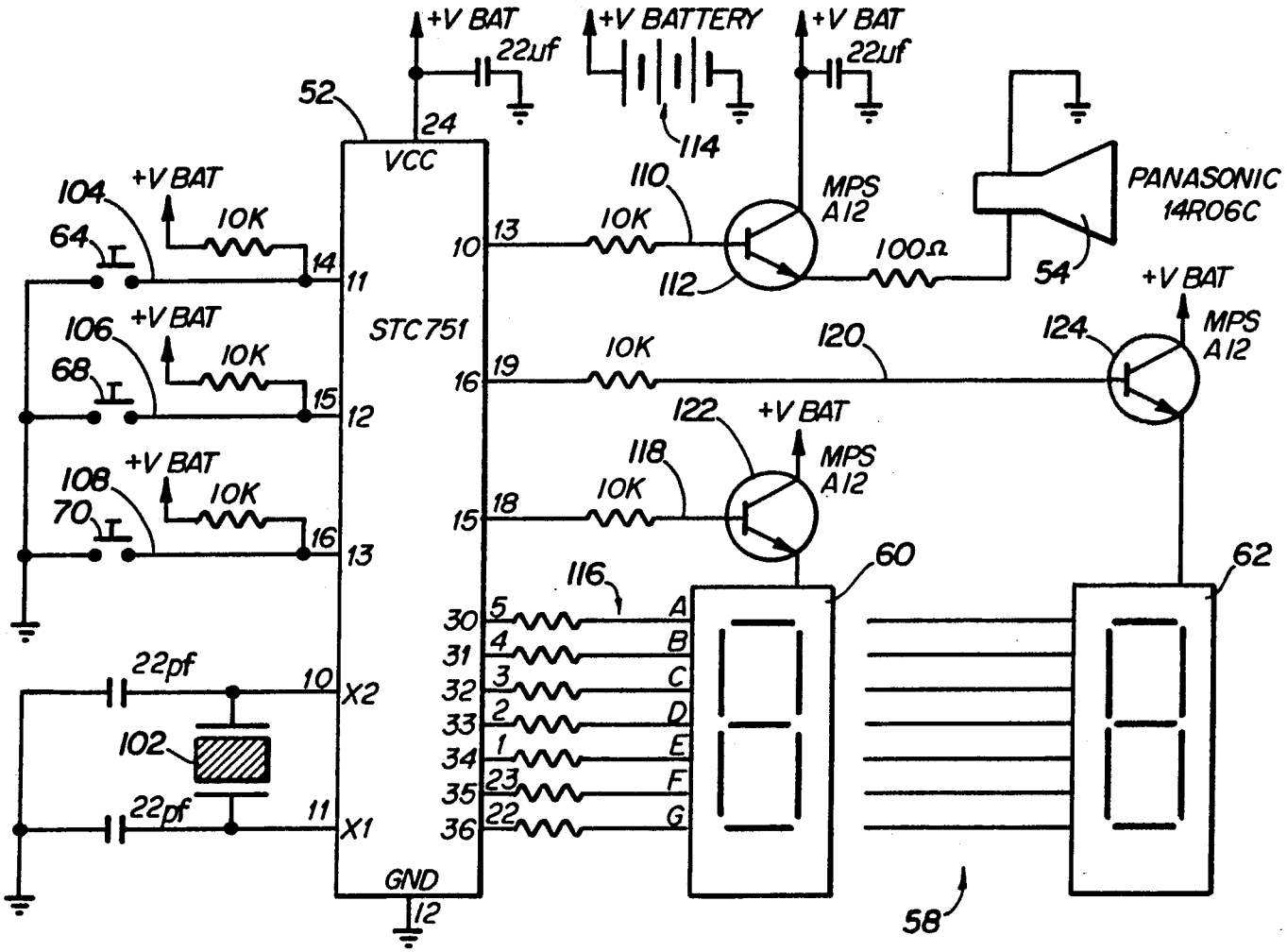
FIG. 5 is a schematic diagram of the electronic circuit used in the alarm system of the present invention

FIG. 5 is a schematic diagram of the electronic circuitry used in the alarm system. At the heart of the alarm system is the microcontroller 52, which is clocked by a 4 MHz oscillator 102. Switches 64, 68 and 70 provide control inputs to the microcontroller 52. Actuator switch 64 is configured such that it is open if the trigger locking device 12 is attached in its operative position about the trigger guard 18. While activator switch 64 remains open, the voltage of signal line 104 corresponds to a logical "1." If the locking device 12 is removed from the trigger guard 18, then switch 64 will close causing the voltage of signal line 104 to drop to ground, corresponding to a logical "0."

If the "select" switch 68 is left open, then the voltage on signal line 106 will stay at a logical "1." When the "select" switch 68 is closed, the voltage on signal line 106 falls to a logical "0." When the switch 68 is depressed, it signals the microcontroller 52 to enter a routine which causes the numerical display 58 to increment the displayed numbers.

If the "enter" switch 70 is left open, then the voltage on signal line 108 will stay at a logical "1". When "enter" switch 70 is closed, the voltage on signal line 108 falls to a logical "0." This switch signals the microcontroller that the displayed combination is to be entered.

If the microcontroller 52 determines that an alarm condition exists, then it will raise the voltage of signal line 110 to a logical "1," turning transistor 112 "ON." This allows current to flow from the power supply 114 to the horn 54. When current flows to the horn 54, an alarm noise will emanate therefrom.

The microcontroller 52 drives the seven-segment display units 60, 62 by placing logical "1" and "0" voltage values on segment lines 116 that correspond to the numbers being displayed. When the proper value has been placed on the segment lines 116, the desired display unit will be enabled by placing a logical "1" on the enabling line 118 or 120 that corresponds to the desired display unit. Placing logical "1" values on these lines 118, 120 turn on driver transistors 122 and 124, powering seven-segment display units 60, 62, respectively.

When displaying numbers, the microcontroller 52 will alternate between displaying a numeral on display unit 60 and displaying a numeral on display unit 62 at a rate faster than that detectable by the human eye. In this way, both display units can share segment lines 116 without a need for additional switching devices.

OPERATION

To operate this device, a battery 114 is inserted into the battery receptacle 94 and the locking device 12 is fixed around the trigger 16 of the firearm 20.

The activator switch 64 is forced in by the compression of the sponge-like cushions 40 against the trigger guard 18. The switch 64 provides the activation input signal to the microcontroller 52 to activate the alarm system. Once activated, "--" appears on the display 58. The electronic horn 54 also sounds three short tones when activated.

If the microcontroller 52 receives a signal from switch 64 indicating the decompression of the cushions 40 from switch 64 and if the microcontroller 52 has not received the correct code from the keypad 66, then it will activate the electronic horn 54, thereby sounding an alarm. It will continue to sound the alarm, either until the correct combination is entered on the keypad 66 or until the battery 112 runs out of energy.

To deactivate the alarm, the user opens the protective cover 72 and presses either key 68, 70 of the key pad 66. This causes "00" to appear on the display 58. The user then presses the "select" key 68, causing the numbers in the display 58 to increment from "00" to "99." If the numbers reach "99," they reset to "00" and the user can continue to increment them. Once the correct code is visible in the display 58, the user depresses the "enter" key 70. This disarms the alarm 114 and the user may then remove the trigger lock 112 so that it assumes an inoperative position without any alarm sounding, thereby allowing movement of the trigger 16.

If the user presses the "enter" key 70 without the correct code appearing in the display 58, then the display 58 will be reset to "00" and the user must repeat the disarming procedure. If the user pushes the "enter" key 70 four times without having the correct security code on the display 58, the alarm will sound until the correct code has been entered.

If the user activates the alarm circuit but fails to take any further action for thirty seconds, the system will deactivate and the circuit will power down. If at any time the voltage of the battery 114 drops below a predetermined minimum, the alarm 54 will sound, alternating three second bursts of sound with three seconds of silence.

It is understood, of course, that the above-described deactivation sequence is arbitrary. Any particular steps regarding the deactivation of the alarm 54 can be set by the user.

Figure 6:
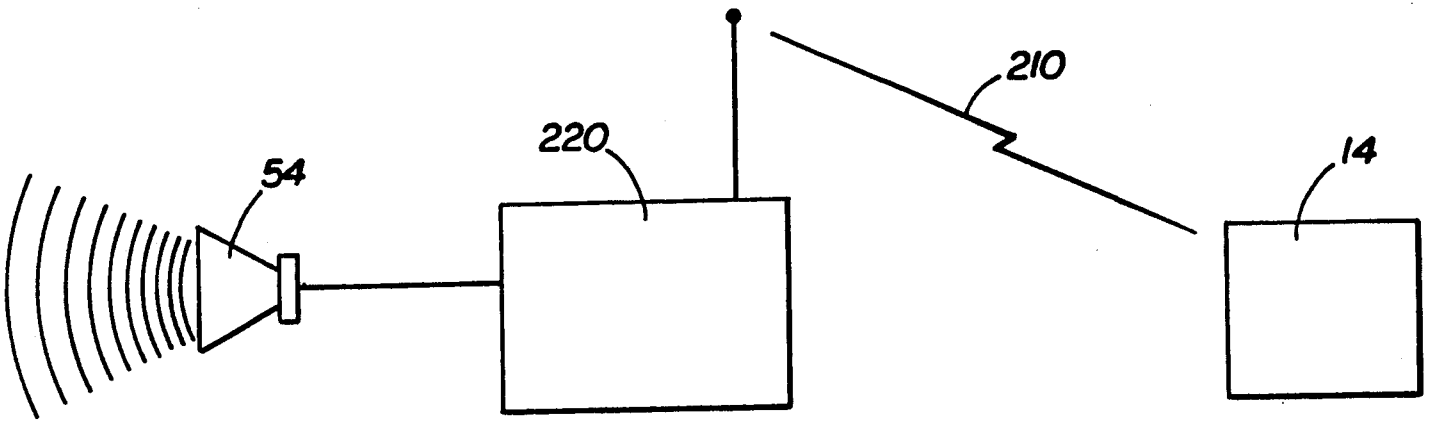
FIG. 6 shows, in schematic form, an alarm sound being generated by having the alarm generating means send a radio-frequency signal to a remote receiving station which sounds the alarm.

It is further understood that the alarm generating means 14 can be adapted for any particular firearm safety device. Also, referring to FIG. 6, the alarm sound could be generated by having the alarm generating means 14 send a radio-frequency signal 210 to a remote receiving station 220 which sounds the alarm 54.

What is claimed is:

1. A trigger lock for preventing unauthorized use of a firearm, comprising:

a. a trigger locking means moveable between an operative position on the firearm preventing movement of the trigger an inoperative position allowing movement of the trigger;

b. an actuator means to detect between the operative and inoperative positions of the trigger locking means and to generate a position signal indicative of the position of the trigger locking device;

c. numerical combination entry means to enter a numerical combination and to generate a numerical combination signal indicative of the numerical combination;

d. numerical combination display means to display the numerical combination indicated by the numerical combination signal;

e. signal processing means responsive to the position signal and the numerical combination signal to generate an alarm signal when the position signal and the numerical combination signal indicate an unauthorized attempt to use the firearm; and f. alarm indicator means responsive to the alarm signal to emit an audible alarm when the unauthorized attempt to use the firearm is indicated.

2. The firearm trigger lock of claim 1, wherein the signal processing means is a digital microcontroller.

3. The firearm trigger lock of claim 2, wherein the numerical combination display means is a plurality of seven-segment displays.

4. The firearm trigger lock of claim 3, wherein the alarm indicator means is an electronic horn.

5. The firearm trigger lock of claim 4, wherein the actuator means is a switch in the trigger locking means which is actuated when the trigger locking means assumes the operative position.

6. The firearm trigger lock of claim 3, wherein the actuator means is a switch in the trigger locking means which is actuated when the trigger locking means assumes the operative position.

7. The firearm trigger lock of claim 2, wherein the actuator means is a switch in the trigger locking means which is actuated when the trigger locking means assumes the operative position.

8. The firearm trigger lock of claim 7, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means is the switch on a selected one of the elements which is actuated when the trigger locking means assumes the operative position.

9. The firearm trigger lock of claim 2, wherein the alarm indicator means is an electronic horn.

10. The firearm trigger lock of claim 9, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means is a switch on a selected one of the elements which is actuated when the trigger locking means assumes the operative position.

11. The firearm trigger lock of claim 2, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means is a switch on a selected one of the elements which is actuated when the trigger locking means assumes the operative position.

12. The firearm trigger lock of claim 1, wherein the numerical combination display means is a plurality of seven-segment displays.

13. The firearm trigger lock of claim 1, wherein the alarm indicator means is an electronic horn.

14. The firearm trigger lock of claim 13, wherein the actuator means is a switch in the trigger locking means which is actuated when the trigger locking means assumes the operative position.

15. The firearm trigger lock of claim 13, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means is a switch on a selected one of the elements which is actuated when the trigger locking means assumes the operative position.

16. The firearm trigger lock of claim 1, wherein the actuator means is a switch in the trigger locking means which is actuated when the trigger locking means assumes the operative position.

17. The firearm trigger lock of claim 16, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means if the switch on a selected one of the elements which is actuated when the trigger locking means assumes the operative position.

18. The firearm trigger lock of claim 1, wherein the trigger locking means comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein the actuator means is a switch on a selected one of the elements which is actuated when the trigger locking means assumes the operative position.

19. A trigger lock for preventing unauthorized use of a firearm, comprising:

a. a trigger locking device moveable between an operative position on the firearm preventing movement of the trigger and an inoperative position allowing movement of the trigger;

b. alarm means on the device for sending a radio frequency signal to indicate an unauthorized attempt to move the trigger locking device to the inoperative position; and c. a remote receiving station for receiving the radio frequency signal and for sounding an alarm in response thereto.

20. The firearm trigger lock of claim 19, wherein the trigger locking device comprises:

a. a frame;

b. a first element on the frame;

c. a second element moveable on the frame; and d. means for securing the second element on the frame at a selected distance from the first element so as to engage therebetween, and prevent access to, at least the trigger in the operative position and wherein an actuator means is a switch on a selected one of the elements which is actuated when the trigger locking device assumes the operative position.

* * * * *